United States Patent [19]

Marcon

[11] 3,967,760

[45] July 6, 1976

[54] ACTUATORS FOR PRESSURIZED CONTAINERS

[75] Inventor: Christian Marcon, Bonneuil, France

[73] Assignee: VCA Corporation, Baton Rouge, La.

[22] Filed: May 19, 1975

[21] Appl. No.: 579,022

[30] Foreign Application Priority Data

May 21, 1974 France ..... 74.17565

[52] U.S. Cl. ..... 222/153; 222/402.11; 222/402.13

[51] Int. Cl.[2] ..... B67D 5/32

[58] Field of Search ..... 222/402.11, 153, 182, 222/402.13, 402.15

[56] References Cited

UNITED STATES PATENTS

| | | | |
|---|---|---|---|
| 3,236,421 | 2/1966 | Glazier | 222/182 X |
| 3,540,624 | 11/1970 | Green | 222/153 X |
| 3,734,353 | 5/1973 | McIlhenny | 222/402.11 X |

*Primary Examiner*—Stanley H. Tollberg
*Assistant Examiner*—John P. Shannon
*Attorney, Agent, or Firm*—Donald L. Johnson; John F. Sieberth; E. Donald Mays

[57] ABSTRACT

An actuator cap assembly for an aerosol dispenser. The cap includes a body having a slide surface formed thereon, and a movable slide carriage member mounted in the slide for linear movement. The carriage is movable between a first position where the actuator button of the aerosol dispenser can be actuated and a second position where it is not possible to activate the dispenser button.

10 Claims, 8 Drawing Figures

18
19
12
13
3
11
9
7
20
17
16
8
2
4
5
10
1
6
14
3
11
14
2
6
19
19
20
7
6
3
11
6

ACTUATORS FOR PRESSURIZED CONTAINERS

This invention relates to actuator cap assemblies for pressurised dispensers of the kind commonly known as aerosol cans.

Such actuator caps comprise a body adapted to be mounted on an aerosol can and an operating button movable in the body and arranged to operate a valve of the can through which the pressurised contents of the can can be discharged. The operating button is easy to press and consequently may readily be operated accidentally and in particular may readily be operated by young children. It is an object of this invention to provide locking means whereby the risk of such accidental operation of an aerosol can is reduced.

According to the present invention we provide an actuator cap assembly for an aerosol can comprising a body adapted to be mounted on an aerosol can and formed with a slide, and a movable slide member comprising a carriage mounted in the slide for linear movement therealong between a first position and a second position and a button connected to and movable relative to the carriage, the arrangement being such that when in use on an aerosol can operation of the valve can be brought about by moving the button relative to the carriage when the carriage is in its first position and operation of the valve by the button is not possible when the carriage is in its second position.

Prevention of operation of the valve by the button when the slide member is in its second position may be brought about by preventing movement of the button relative to the carriage by some means such as, for example, an abutment with which the button engages in the second position. Alternatively the parts of the assembly may be arranged such that they are aligned to operate the valve when the slide member is in its first position but are misaligned so that the valve cannot be operated when in the second position.

Some embodiments of the invention will now be described, by way of example only, with reference to and as shown in the accompanying drawings, in which.

Figure 5:
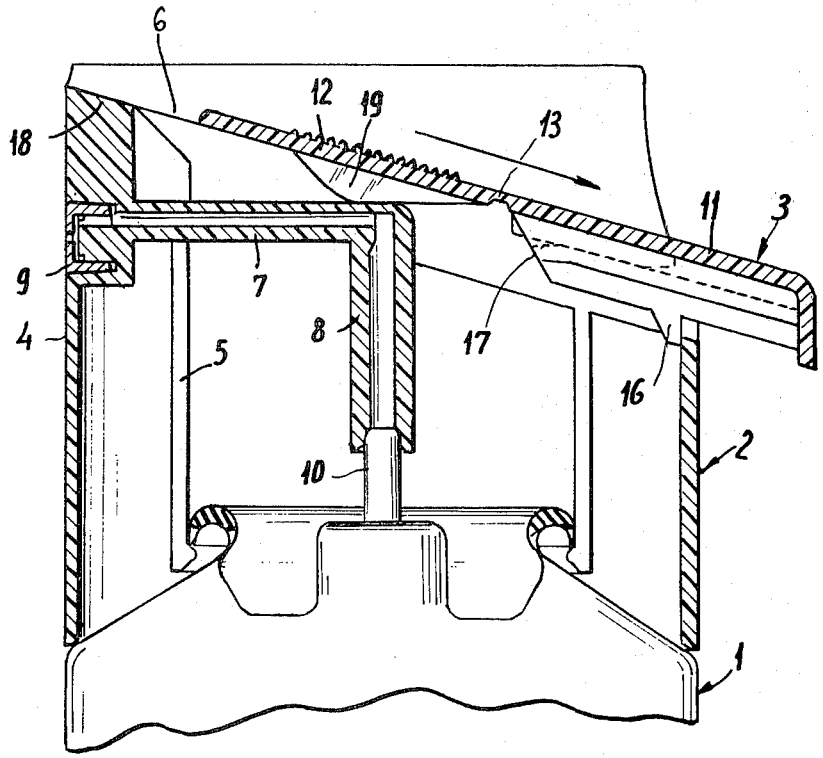
FIG. 5 is a view similar to FIG. 1 in which the button of the slide is shown in its first or operative position.
Figure 6:
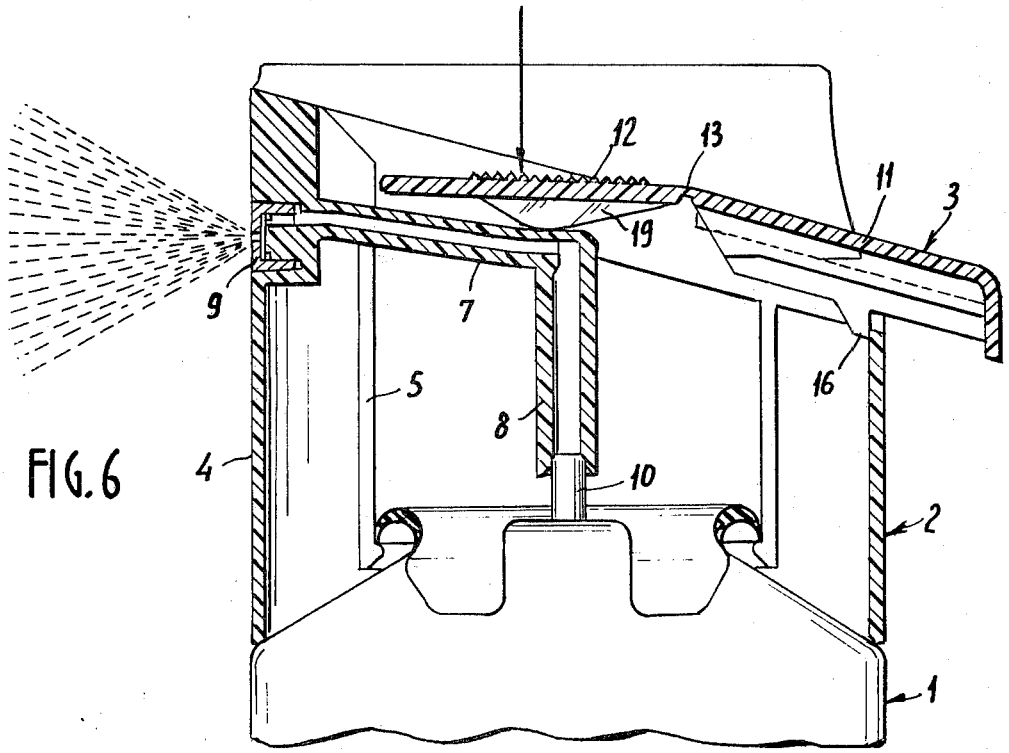
Figure 7:
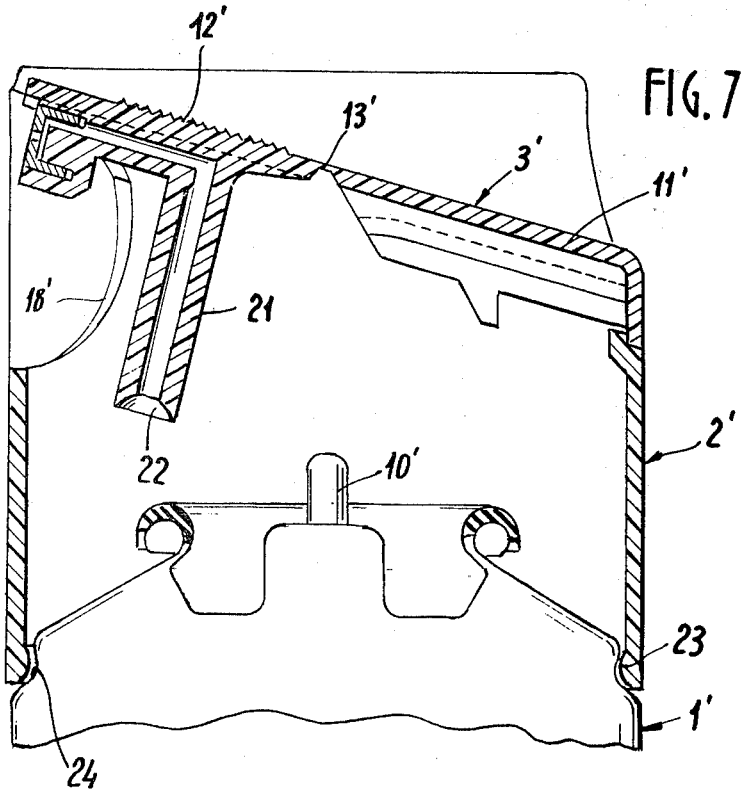
Figure 8:
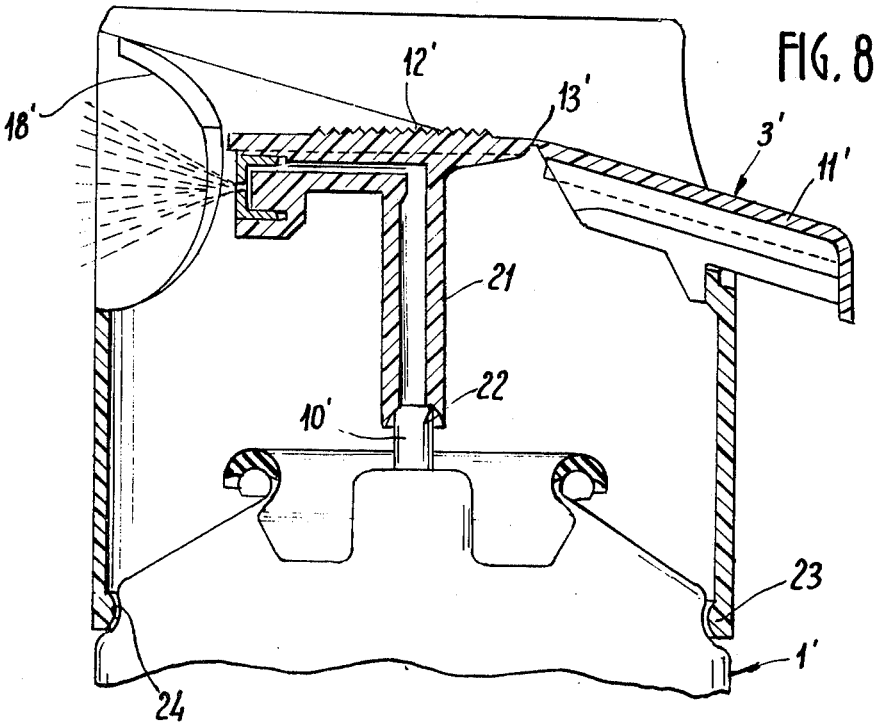

FIG. 6 is a view similar to FIG. 5 showing the slide in its first or operative position and the button pressed down to discharge the contents of the can; and FIGS. 7 and 8 are sectional views of another actuator cap assembly embodying the invention, the sections being taken on an axial plane of an aerosol can on which the cap is mounted, the figures showing the slide in the inoperative and operative positions respectively.

The manual spray actuator cap assembly shown in FIGS. 1 to 6, is mounted on an aerosol container 1. The assembly comprises essentially a stationary body 2 and a movable slide member 3 moulded in a resiliently deformable synthetic resin material. The stationary body 2 comprises two concentric skirts 4 and 5, of which the inner one 5 is retained on the valve mounting cap of the container 2, and an upper wall 6 joining the two skirts together at their upper ends. A cranked tube 7,8 is formed integrally at one end with the outer skirt, this end opening to the outside of the body by way of a spray orifice terminated by an inset 9, and the other end fits onto the actuating stem 10 of the outlet valve. The tube 7,8 is resiliently deformable over that part of it which lies between its crank bend and the skirt 4.

The movable slide member 3 comprises a carriage 11 to which a button 12 is linked by a reduced portion 13 forming a hinge. The slide member 3 is movable between two positions, a first or operative position shown in FIGS. 5 and 6 and a second or inoperative position shown in FIG. 1. Movements of the slide member 3 are controlled by two ribs 14 on the upper wall 6 forming a slide. The ribs 4 engage in corresponding grooves 15 formed in the carriage 11 of the slide member 3. The interengagement of the ribs 14 and the grooves 15 ensures retention of the slide member 3 on the stationary body 2, permitting only longitudinal movement of the carriage 11.

Figures 1, 2, 3, 4:
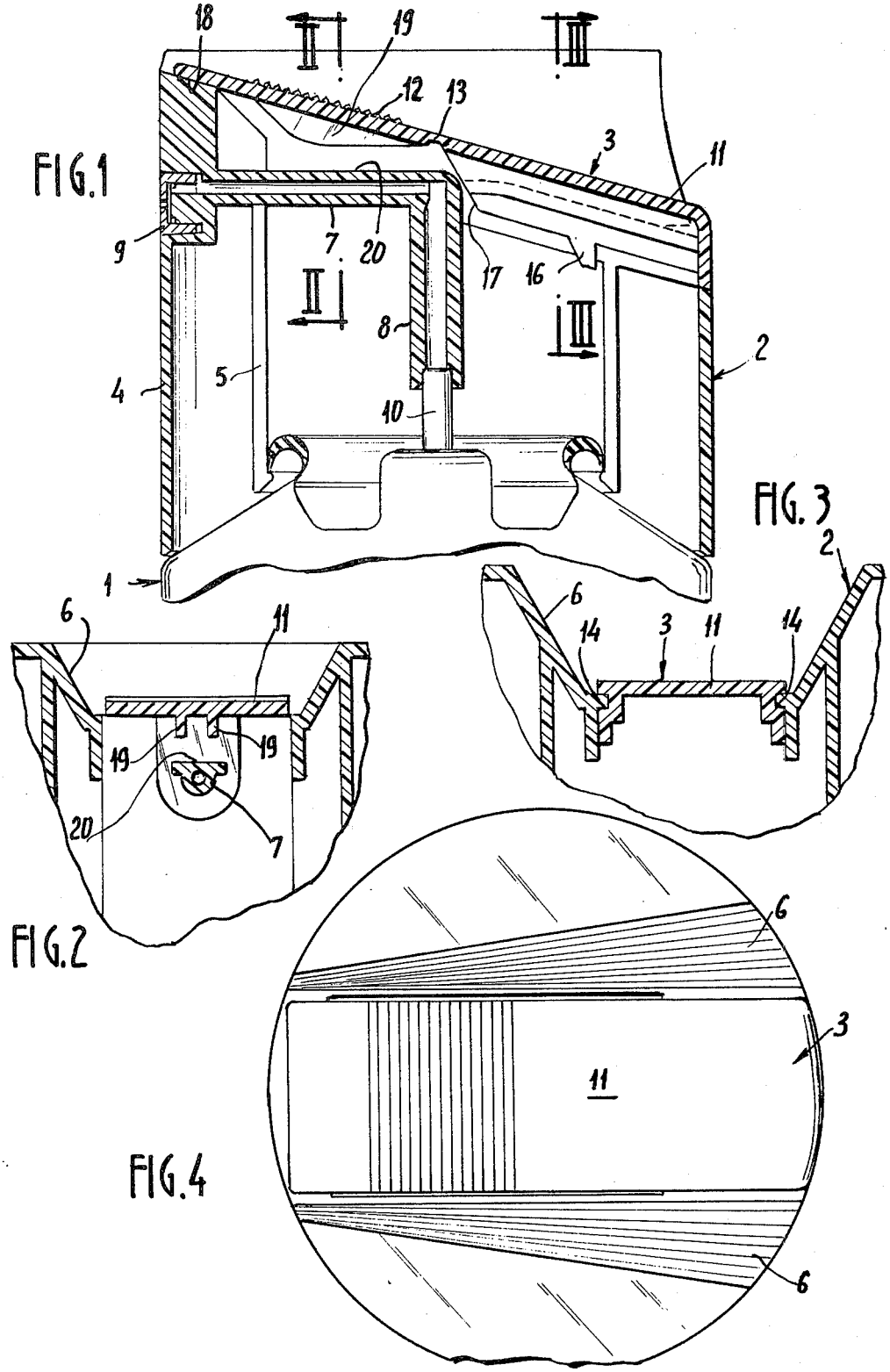
FIG. 1 is a sectional view of an actuator cap assembly embodying the invention, the section being taken on an axial plane of an aerosol can on which the cap is mounted, the button being shown in its second or inoperative position.
FIG. 2 is a partial transverse section on the line II—II in FIG. 1.
FIG. 3 is a partial transverse section on the line III—III in FIG. 1.
FIG. 4 is a plan view of the cap shown in FIG. 1.

A lug 16 and an abutment 17 on the carriage 11 of the slide member 3 ensure, by their cooperation respectively with the outer skirt 4 and with the cranked tube 7,8, restriction of movement of the carriage 11 and of the button 12 to the extreme diametral positions shown in FIGS. 5 and 6 and in FIG. 1. In the position shown in FIG. 1 the abutment 17 cooperates with the cranked tube 8,9 and the button 12 is locked in a non-operative position by the engagement of its free end with an abutment 18 on the stationary body, which prevents any downward pivotal movement.

In the position shown in FIGS. 5 and 6 the button 12 can be pivoted manually about its flexible connection 13 from an upper free position shown in FIG. 5 to a lower position shown in FIG. 6 in which it causes the valve on the container 1 to open and to dispense its contents. The button 12 acts on the valve through the cranked tube 7,8 in the region of the crank bend in it and on the axis of the longitudinal part 8 of the tube 7,8. As long as there is no manual pressure exerted on the button 12, the latter is urged resiliently to the position shown in FIG. 1. The lug 16 mounted on the slide member 3 and cooperates with the outer skirt 4 to prevent the slide member coming away from the body when it is shifted from its inoperative position to its operative position.

To facilitate control of the valve on the container by the button 12, the lower face of the latter carries a cam 19 formed by two parallel projections engaging a flat surface 20 provided on the upper part of the transverse portion 7 of the cranked tube 7,8.

The embodiment shown in FIGS. 7 and 8 differs from that of FIGS. 1 to 6 in that the button 12′ of the slide member 3′ itself carries a spray mouthpiece 21 which engages the actuating stem 10′ of the outlet valve. The dispensing mouthpiece 21 is provided on its free end with an abutment 22 for forming a sealed connection with the end of the stem 10′ despite the relative sliding movement of the said mouthpiece and the stem. The body 2′ moreover only has a single lateral skirt. This skirt is provided with an internal bead 23 engaging an annular step 24 on the aerosol can.

Starting from the position of the slide member 3′ shown in FIG. 7, the operation of the valve on the container 1′ to dispense the product within the can is achieved by first shifting the slide member 3′ to align the mouthpiece 21 with actuating stem 10' of the valve. The button 12' is then pivoted about its flexible connection 13, to bring about sealed engagement of the mouthpiece 21, by way of its abutment 22, with the valve stem 10' on the said valve, and then cause displacement of the stem 10' to open the valve.

It will be understood that the invention is not limited to the embodiments described and illustrated but is open to numerous modifications without departing from the spirit of the invention. For example in one particular modification the button may cooperate directly with a known type of spray head mounted on the valve and independent of the slide and the actuator cap. The whole assembly is like that of FIGS. 1 to 6 save in that the tube 7,8 with its insert 9 forms a separate member mounted on the valve stem 10, the inset 9 opening through a cut-out portion of the body of the head, as in FIG. 8.

What is claimed is:

1. An actuator cap assembly for an aerosol can having a valve with a projecting valve stem comprising: a body having an upper wall providing a central, longitudinal slot thereacross, and a skirt portion depending from the upper wall of said body adapted to be mounted on an aerosol can; means on the rear portion of said upper wall adjacent said slot forming a slide; a movable slide member comprising a rear carriage portion mounted in said slot supported and continuously engaged by the slide for linear movement only therealong between a first position and a second position, and a forward button portion hingedly connected to said rear carriage portion at its forward end and movable relative to the carriage, the arrangement being such that when in use on an aerosol can operation of the valve can be brought about by moving the forward button portion relative to the rear carriage portion when the rear carriage portion is in its first position and operation of the valve by the forward button portion is not possible when the rear carriage portion is in its second position.

2. An actuator cap assembly according to claim 1, in which means is provided on said cap to prevent movement of the button portion relative to the carriage portion when the carriage portion is in its second position.

3. An actuator cap assembly according to claim 1, in which an abutment is provided with which the button portion engages when the carriage portion is in its second position.

4. An actuator cap assembly according to claim 1 in which the slide member is provided with stop means to retain it on the slide means and to define said first and second positions.

5. An actuator cap assembly according to claim 1 in which the rear carriage portion is provided with a lug on its underside that engages the body to limit rearward movement of the slide member.

6. An actuator cap assembly according to claim 1 including a cranked tube one end of which is adapted to fit onto an aerosol can valve stem and the other end of which is provided with a spray orifice opening to the outside of the body, the button portion when in use acting on the valve stem by way of the cranked tube.

7. An actuator cap assembly according to claim 6 in which the cranked tube is fixed to the body at its spray end and is resiliently deformable so that its valve stem end can be moved to operate the valve by movement of the button portion.

8. An actuator cap assembly according to claim 6 in which the cranked tube is fixed to the button portion so that its valve end can be moved, by movement of the slide member, into and out of alignment with the valve of an aerosol can when in use.

9. An actuator cap assembly according to claim 7 in which the underside of the button portion is provided with cam means which are engageable with the cranked tube.

10. An actuator cap assembly according to claim 7 in which the rear carriage portion is provided with an abutment on its underside that engages the cranked tube to limit forward movement of the slide member.

* * * * *